US006116760A

United States Patent [19]

Cox

[11] Patent Number: 6,116,760

[45] Date of Patent: Sep. 12, 2000

[54] LIGHT STAKE

[75] Inventor: Gary Cox, Joplin, Mo.

[73] Assignee: Southwestern Products, Inc., Joplin, Mo.

[21] Appl. No.: 09/041,911

[22] Filed: Mar. 13, 1998

[51] Int. Cl.[7] ..... F21S 1/10

[52] U.S. Cl. ..... 362/431; 362/396; 362/249

[58] Field of Search ..... 362/249, 227, 362/806, 382, 392, 396, 431, 391; 248/156, 508, 507

[56] References Cited

U.S. PATENT DOCUMENTS

| | | | |
|---|---|---|---|
| D. 282,711 | 2/1986 | Nelson | D8/1 |
| D. 326,998 | 6/1992 | Gabriel | 248/156 |
| 1,223,276 | 4/1917 | Haney | 248/156 |
| 2,021,303 | 11/1935 | Grennan | 248/156 |
| 2,536,341 | 1/1951 | Asher | 248/156 |
| 2,894,706 | 7/1959 | Cappio | 248/156 |
| 5,667,174 | 9/1997 | Adams | 248/156 |

*Primary Examiner*—Sandra O'Shea
*Assistant Examiner*—Peggy A Neil
*Attorney, Agent, or Firm*—Hovey, Williams, Timmons & Collins

[57] ABSTRACT

A light stake particularly useful for mounting ornamental electrical lighting is provided which includes an elongated shank and a head presenting small and large loops for respectively mounting smaller and larger light sockets. The head is angularly oriented relative to the shank and the large and small loops are cooperatively formed, preferably oriented in opposite directions. The light stake is most economically formed of a single piece of resilient wire, and may mount either a small socket, a large socket, or small and large sockets simultaneously.

2 Claims, 1 Drawing Sheet

LIGHT STAKE

BACKGROUND OF THE INVENTION

1. Field of the Invention

This invention relates to a stake used to hold and elevate lights, and in particular ornamental lights, and is configured to mount lights of different light socket dimensions. More particularly, it is concerned with a light stake configured to releasably retain one of a plurality of sockets of lights in a string whereby a single stake can economically mount lights of either or both of two different socket sizes.

2. Description of the Prior Art

Placement of lights along the side of a pathway is a custom during Christmas. The lights, called "luminaria" were traditionally candles which were placed in lanterns and lit on Christmas eve to symbolically light the pathway of the baby Jesus to a home. In many residential neighborhoods, candles or flashlights were held in sand within a paper bag, which diffused and colored the light, such that sidewalks and entrance walkways of entire neighborhoods are illuminated.

More recently, a series of electric ornamental lights connected to a common electrical wire have been used as luminaria. These electric ornamental lights are popular in both "mini" and "regular" sizes. Because of the need to elevate the lights above accumulated snowfall to display the lights and to avoid the intrusion of moisture into the socket, small wire stakes have been used to hold the sockets of the bulbs. However, the light stakes heretofore developed have been configured to accommodate sockets of only one size. Thus, it has been necessary to manufacture separate light stakes for both mini and regular sizes of socket. Some purchasers use one or two different sizes of sockets, and it has not heretofore been feasible to use lights with sockets of both different sizes in combination. Moreover, some purchasers mistakenly purchase one size of light stake when desiring another, or have purchased both sizes of light stakes and commingled them, requiring sorting of the very similar stakes prior to use.

SUMMARY OF THE INVENTION

These problems have largely been solved by the light stake in accordance with the present invention. That is to say, the present invention provides an economical light stake which is adaptable for use with either size of socket or, most conveniently, can simultaneously mount both regular and mini sized sockets. By a unique configuration, the light stake hereof uses a minimum of additional material, is easy to fabricate, and provides improved user flexibility.

These and other objects will be readily apparent to those skilled in the art with reference to the following description and drawings:

DESCRIPTION OF THE PREFERRED EMBODIMENTS

Figures 1, 2, 3, 4, 5, 6, 7:
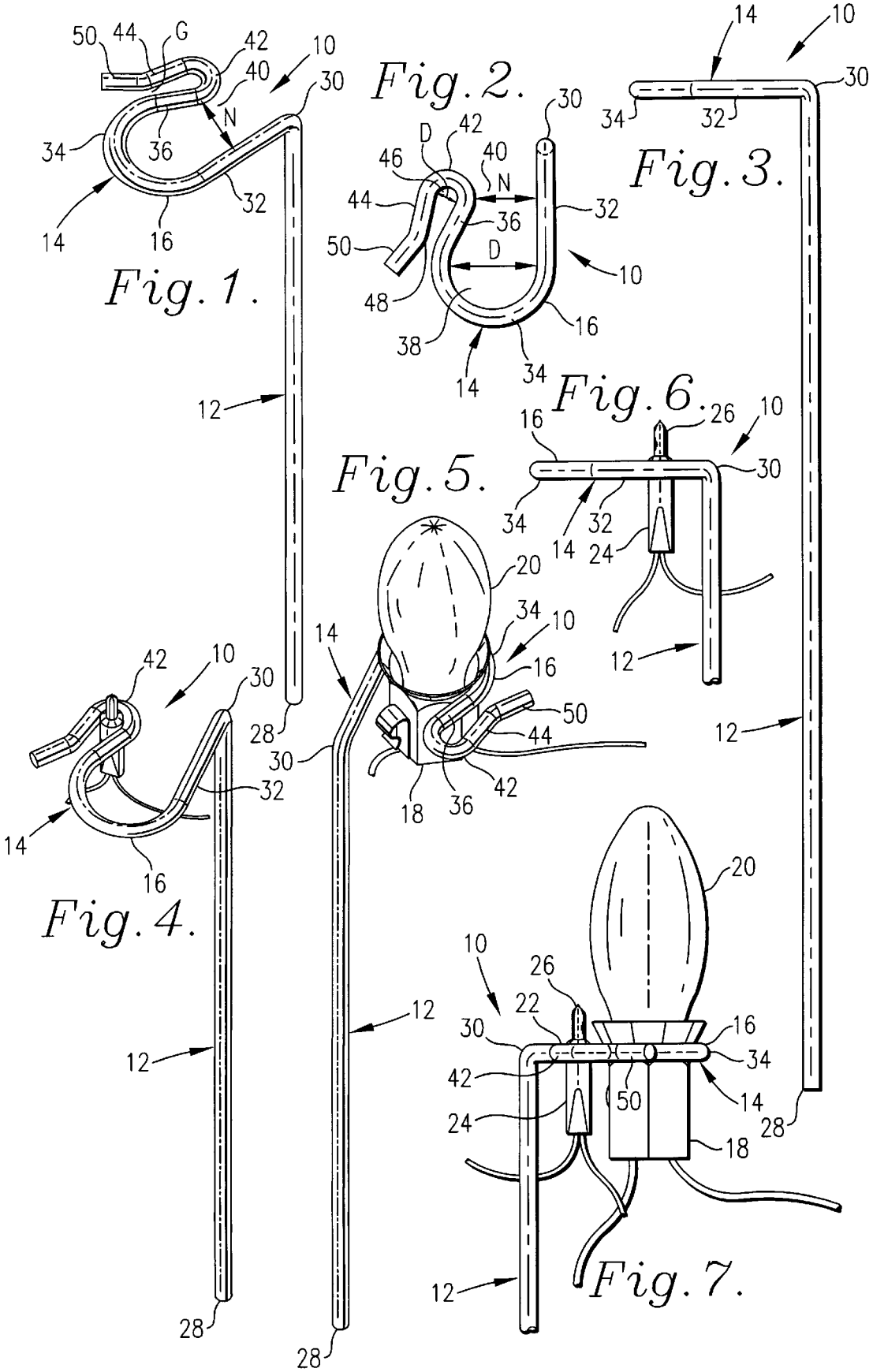
FIG. 1 is a perspective view of the light stake hereof showing an elongated shank and multicurve head forming small and large loops for accommodating differently sized light sockets.
FIG. 2 is a top plan view thereof.
FIG. 3 is a side elevation view thereof.
FIG. 4 is a perspective view similar to FIG. 1, showing a mini light of an ornamental light string mounted in the small loop.
FIG. 5 is a perspective view similar to FIG. 4 but with the stake turned 180° to show a regular light socket of an ornamental light string mounted in the large loop.
FIG. 6 is a fragmentary side elevation view similar to FIG. 3 showing the position of a mini light when retained in the small loop.
FIG. 7 is a fragmentary side elevation view similar to FIGS. 3 and 6 but with the light stake turned 180° therefrom to show a regular light socket mounted therein.

Referring now to the drawing, FIGS. 1 through 7 show a light stake 10 in accordance with the preferred embodiment of the present invention which includes an elongated shank 12 and a head 14. The head 14 presents a relatively large loop 16 sized for mounting therein a standard or regular socket 18 of an standard-size ornamental lamp 20, and a small loop 22 sized for mounting therein a smaller or mini socket 24 of a smaller ornamental lamp 26. The light stake 10 is preferably formed of a single length of resilient wire bent to shape, but it may be appreciated that the light stake may also be formed of two or more interconnected pieces and that it may be molded or shaped of synthetic resin or other resilient material.

In greater detail, the shank 12 is elongated and while it may be made of any length to elevate the lamps a desired distance above the ground, a shank length of 6 to 8 inches is a typical economical length. The shank presents a ground-penetrating end 28 which typically need not be sharpened to achieve penetration. The shank 12 is most preferably formed of mild steel wire of a diameter of from about 0.06 to 0.12 inches, which provides sufficient ground penetrating ability, is resistant to ultraviolet rays and easily workable, as well as resilient. The shank 12 is connected to the head 14 at turn 30 which orients the shank 12 at approximately a 90° angle to head 14 as shown in FIGS. 3, 6 and 7.

The head 14 is preferably integrally formed with the shank 12 of a continuous length of wire. The head 14 includes a stem 32 extending from turn 30 at a right angle to shank 12, a large bend 34 and a return arm 36 which together form large loop 16. The large loop 16 forms a curved large throat 38 and a neck 40 between the stem 32 and return arm 36. The large throat 38 presents a greatest transverse dimension D which is greater than the transverse dimension N of neck. The head 14 also includes a small bend 42 and a nose 44 which together with return arm 36 form small loop 22. The small loop 22 defines a curved small throat 46 which presents a greatest transverse dimension D', which is greater than the transverse dimension G of a gap 48 formed between the return arm and the nose 44, with the transverse dimension D' of small throat 46 being smaller than the transverse dimension D of large throat 38. The transverse dimension G at gap 48 is also smaller than the transverse dimension N of neck. A guide 50 extends from the nose 44 and diverges from large bend 34.

In use, the light stake 10 hereof is sufficiently economical to make that a number of the stakes can be purchased and used to hold light sockets in a string of ornamental lights. A regular socket 18 of a standard sized lamp 20 is inserted into the large throat 38 of large loop 16 as shown in FIGS. 5 and 7. The return arm 36 is spread to clamp the socket 18 between the return arm 36 and the stem 32, with the spreading action causing the large bend to resiliently bias the return arm 36 toward the stem 32. As shown in FIG. 4, a mini socket 24 of a smaller ornamental lamp may be received in the small loop 22 when the nose 44 is spread to receive the mini socket in the small throat 46. The spreading action causes the nose 44 to be resiliently biased toward the return arm and clamp the mini-socket therebetween. The guide 50 eases the task of spreading the nose 44 away from the return arm 36, and guides the mini socket 24 into the small loop 22. Similarly, the user may grasp the small bend, return arm or the nose to pull the return arm 36 away from the stem 32 for inserting a regular socket 18 into the large loop 16, with the curved outer surface of the small bend 42 serving to aid in guiding the socket 18 during insertion.

As shown in FIG. 7, it may be appreciated that the structure of the light stake 10 uniquely permits simultaneous mounting of both regular socket 18 and mini socket 24 on a single stake 10. Thus, the light stake 10 hereof uniquely provides the capability to accommodate two lights of different sizes on a single stake, which provides an improved appearance and reduced cost by avoiding the necessity of placement of two different stakes for differently sized lights. The placement of the large loop 16 and the small loop 22 cooperate to enable the return arm 36 to function as a part of both the large loop 16 and the small loop 22, providing enhanced economy and allowing the regular socket 18 and mini socket 24 to be placed in immediate adjacency.

Once the light socket or two light sockets are mounted in the head 14, the user may position the light stake 10 in the desired location and insert the shank 12 into the ground a sufficient distance to support the stake 10 and any lights mounted thereon. The amount of penetration to accomplish this function will vary according to temperature, moisture, soil type and vegetation, and the distance the lamps should be elevated above the ground will be a matter of user choice.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

What is claimed is:

1. A light stake for holding at least one light socket comprising:

an elongated shank; and a head connected to said shank and extending substantially perpendicular thereto wherein said head lies in a substantially horizontal plane when said shank is vertical, said head and said shank being interconnected by a turn whereby said shank and said head are unitary and formed of a substantially continuous length of resilient wire, said head presenting a first relatively large socket-receiving loop including a substantially stem oriented substantially 90° to said shank by a turn, a large arcuate bend connected to said stem to present a first throat sized to receive a socket therein, and a substantially linear return arm defining a neck between said stem and said return arm of a narrower transverse dimension than said first throat, and a second, relatively smaller socket-receiving loop oriented generally opposite to said first loop and defined by said return arm, a small arcuate bend defining a second throat sized to receive a socket therein and having a transverse dimension narrower than said first throat, and a substantially linear nose wherein said bend is greater than 180° to cause said nose and said return arm to converge to define a gap therebetween which has a narrower transverse dimension than said second throat, and further including a guide extending at an oblique angle relative to said nose, said gap being oriented in a substantially opposite direction to said neck.

2. A light stake as set forth in claim 1, said head further including a guide formed of said continuous length of wire and extending at an oblique angle to said nose.

* * * * *